US010830019B1

(12) United States Patent
Hou et al.

(10) Patent No.: US 10,830,019 B1
(45) Date of Patent: Nov. 10, 2020

(54) METHOD FOR ENHANCING GAS RECOVERY OF NATURAL GAS HYDRATE RESERVOIR

(71) Applicant: China University of Petroleum (East China), Qingdao (CN)

(72) Inventors: Jian Hou, Qingdao (CN); Ermeng Zhao, Qingdao (CN); Yongge Liu, Qingdao (CN); Kang Zhou, Qingdao (CN); Bei Wei, Qingdao (CN); Yunkai Ji, Qingdao (CN); Nu Lu, Qingdao (CN); Yajie Bai, Qingdao (CN); Wenbin Liu, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 16/600,842

(22) Filed: Oct. 14, 2019

(30) Foreign Application Priority Data

Jun. 10, 2019 (CN) ..... 2019 1 0496581

(51) Int. Cl.

| | |
|---|---|
| ***E21B 41/00*** | (2006.01) |
| ***E21B 33/138*** | (2006.01) |
| ***E21B 43/11*** | (2006.01) |
| ***E21B 43/16*** | (2006.01) |

(52) U.S. Cl.
CPC ..... *E21B 41/0092* (2013.01); *E21B 33/138* (2013.01); *E21B 43/11* (2013.01); *E21B 43/16* (2013.01)

(58) Field of Classification Search
CPC .... E21B 41/0092; E21B 33/138; E21B 43/11; E21B 43/16; E21B 41/00; E21B 43/00; E21B 41/0099
USPC ..... 166/261
See application file for complete search history.

(56) References Cited

U.S. PATENT DOCUMENTS

| | | | | |
|---|---|---|---|---|
| 4,790,375 | A * | 12/1988 | Bridges | E21B 36/006 166/304 |
| 5,621,844 | A * | 4/1997 | Bridges | E21B 36/04 166/60 |
| 7,165,621 | B2 * | 1/2007 | Ayoub | E21B 43/24 166/369 |
| 7,530,392 | B2 * | 5/2009 | Sugiyama | E21B 43/08 166/263 |
| 8,881,843 | B2 * | 11/2014 | Todd | E21B 43/103 175/5 |

(Continued)

FOREIGN PATENT DOCUMENTS

CN 105298463 * 7/2016

OTHER PUBLICATIONS

Google patents translation of CN 105298463, Jan. 22, 2020.*

*Primary Examiner* — Angela M DiTrani Leff
(74) *Attorney, Agent, or Firm* — Volpe Koenig

(57) ABSTRACT

A method for improving the gas recovery of a natural gas hydrate reservoir by using artificial impermeable layers is described. Artificial impermeable layers are formed by injecting cement slurry into the permeable overburden and underburden layers. When depressurization exploitation is performed, a large amount of seawater can be effectively blocked from entering a hydrate layer, and a production pressure difference between the hydrate layer and the production well is effectively increased, so that a hydrate decomposition rate and the gas recovery are improved.

7 Claims, 1 Drawing Sheet

(56) References Cited

U.S. PATENT DOCUMENTS

| | | | | |
|---|---|---|---|---|
| 8,910,712 | B2 * | 12/2014 | Balczewski | E21B 43/24 166/285 |
| 2006/0060356 | A1 * | 3/2006 | Graue | E21B 41/0064 166/305.1 |
| 2007/0144738 | A1 * | 6/2007 | Sugiyama | E21B 43/119 166/250.07 |
| 2009/0236144 | A1 * | 9/2009 | Todd | E21B 17/01 175/5 |
| 2012/0145388 | A1 * | 6/2012 | Bunio | E21B 43/305 166/275 |
| 2016/0258246 | A1 * | 9/2016 | Jandhyala | C09K 8/42 |

* cited by examiner

METHOD FOR ENHANCING GAS RECOVERY OF NATURAL GAS HYDRATE RESERVOIR

CROSS REFERENCE TO RELATED APPLICATIONS

This application claims priority to Chinese Application No. 201910496581.5, filed on Jun. 10, 2019, entitled "METHOD FOR ENHANCING GAS RECOVERY OF NATURAL GAS HYDRATE RESERVOIR", which is specifically and entirely incorporated by reference.

FIELD OF THE INVENTION

The present disclosure relates to a method for enhancing the gas recovery of a natural gas hydrate reservoir, in particular to a method in which cement slurry is injected into a permeable overburden layer and a permeable underburden layer to form artificial impermeable layers to enhance the gas recovery of a natural gas hydrate reservoir.

BACKGROUND OF THE INVENTION

Natural gas hydrates are ice-like compounds formed by natural gas (usually methane) and water molecules under conditions of low temperature and high pressure, and are mainly distributed in a continental permafrost zone and seabed sediments with a water depth of more than 300 meters. Because the natural gas hydrates have advantages such as high calorific values, cleanliness and high efficiency, and huge potential for resources, the natural gas hydrates are regarded as the strategic commanding height of global energy development in the future. Therefore, development of the high efficient exploitation technology for natural gas hydrate reservoirs has important practical significance.

Among global hydrate resources, the proportion of natural gas hydrates in the marine sediments reaches 90% or above, which is a main battlefield for large-scale exploitation in the future. Compared with conventional oil and gas reservoirs, the natural gas hydrate reservoirs in the marine sediments feature shallow burying and poor cementation, and overburden and underburden layer of the natural gas hydrate reservoirs generally have certain permeability. When depressurization exploitation is carried out, seawater enters the bottom of a well through a permeable layer, a large amount of water is ineffectively produced in the production well, and an effective pressure difference cannot be formed between the reservoirs and the production well. Consequently, the hydrate decomposition rate is limited. In addition, the decomposed methane gas may upwardly move into the atmosphere along the permeable layer, and the greenhouse effect is exacerbated. Therefore, the permeability of the overburden and underburden layer significantly affects the development of natural gas hydrate reservoirs. However, currently, there is no effective method for exploiting the hydrate reservoir with a permeable overburden and underburden layer. Consequently, development and utilization of the type of natural gas hydrate reservoir are restricted to a great extent.

SUMMARY OF THE INVENTION

The present disclosure provides a method for enhancing the gas recovery of a natural gas hydrate reservoir. The natural gas hydrate reservoir includes a permeable overburden layer, a hydrate layer and a permeable underburden layer. The method includes: Controlled drilling of a vertical well in the natural gas hydrate reservoir, controlled perforation, in a casing perforation well-completion manner, on the parts, located in the permeable overburden layer and the permeable underburden layer, of a casing; controlled adding of a retarder to oil well cement, and determining the amount of the retarder and the thickening time of the oil well cement, to form a cement slurry system; calculating an injection amount and an injection speed of the cement slurry system, so that the entire cementing construction time is within the thickening time, and it is ensured that the cement slurry system covers the permeable overburden layer and the permeable underburden layer within a control radius of the vertical well; controlled injection of the cement slurry system through the casing, wherein the cement slurry system enters the permeable overburden layer and the permeable underburden layer along a perforation interval of the vertical well, and controlled shutting in the well and wait on cement setting for preset time after the injection is completed, wherein the preset time ranges from 2 d to 4 d, so that the cement slurry system solidifies to form artificial impermeable layers, to implement packing of the permeable overburden layer and the hydrate layer and packing of the permeable underburden layer and the hydrate layer; controlled perforation on the part of the casing located in the hydrate layer controlled lowering of a tubing into the casing and slotting on the part of the tubing located in the hydrate layer controlled installation of packers in a tubing-casing annulus space at the bottom of the permeable overburden layer and a tubing-casing annulus space at the top of the permeable underburden layer, to prevent seawater from entering the tubing through the tubing-casing annulus spaces to affect production efficiency; and controlling operation of the vertical well to perform exploitation in a constant pressure manner, and when a gas production rate is lower than a critical gas production rate, performing well shut-in for ending the exploitation.

Optionally, a finished drilling horizon of the vertical well is located within the permeable underburden layer and the distance between the finished drilling horizon and an interface of the hydrate layer and the permeable underburden layer ranges from 20 m to 40 m.

Optionally, the distance between the lowermost perforation point in the permeable overburden layer and an interface of the hydrate layer and the permeable overburden layer ranges from 4 m to 6 m.

Optionally, the distance between the uppermost perforation point in the permeable underburden layer and an interface of the hydrate layer and the permeable underburden layer ranges from 1 m to 3 m.

Optionally, a length of the perforation in the permeable overburden layer and the permeable underburden layer ranges from 6 m to 10 m.

Optionally, a spacing of the perforations in the permeable overburden layer and the permeable underburden layer ranges from 1 m to 2 m.

Optionally, the amount of the retarder ranges from 2% to 5%, which is a ratio of the quality of the retarder to the quality of the cement slurry.

Optionally, the thickening time ranges from 4 d to 6 d.

Optionally, the step of calculating an injection amount and an injection speed of the cement slurry system includes: calculating the injection amount by using the following formula: $V=\pi r^2 h\phi$, wherein V is the injection amount, r is the control radius, h is an average thickness of the artificial impermeable layer, and $\phi$ is a porosity of the permeable overburden layer and the permeable underburden layer; and calculating the injection speed by using the following formula:

$$q_I = \frac{VS_f}{t_0},$$

wherein $q_I$ is the injection speed, $S_f$ is an injection allowance coefficient, and to is the thickening time.

Optionally, a spacing of the perforations in the hydrate layer ranges from 2 m to 4 m.

Optionally, both the distance between the packer in the overburden layer and an interface of the hydrate layer and the permeable overburden layer and the distance between the packer in the permeable underburden layer and an interface of the hydrate layer and the permeable underburden layer range from 1 m to 2 m.

Optionally, a bottom-hole flowing pressure ranges from 1.5 MPa to 4.0 MPa when the vertical well performs exploitation at constant pressure.

Optionally, the critical gas production rate ranges from 2000 $m^3$/d to 3000 $m^3$/d.

In the method provided by the present disclosure, a natural gas hydrate reservoir with permeable overburden and underburden layers is a construction object. Artificial impermeable layers are formed by injecting cement slurry into the permeable overburden layer and the permeable underburden layer. When depressurization exploitation is performed, the artificial impermeable layers can block a large amount of seawater from entering a hydrate layer, and increase a pressure difference between the hydrate layer and a production well, so that a hydrate decomposition rate and the gas recovery are improved. In addition, the method provided by the present disclosure can effectively prevent decomposed methane gas from moving into the atmosphere through the permeable overburden layers. The well structure used in the method is simple, and the method is convenient to operate and economically strong. The method provides an effective technical means for exploitation of a natural gas hydrate reservoir with permeable overburden and underburden layers.

BRIEF DESCRIPTION OF DRAWINGS

The accompanying drawings are intended to provide a further understanding of embodiments of the present disclosure, constitute a part of the description, and are used to explain the embodiments of the present disclosure with specific embodiments below, but are not intended to limit the embodiments of the present disclosure. In the accompanying drawings.

Description of reference numerals

Figure 1:
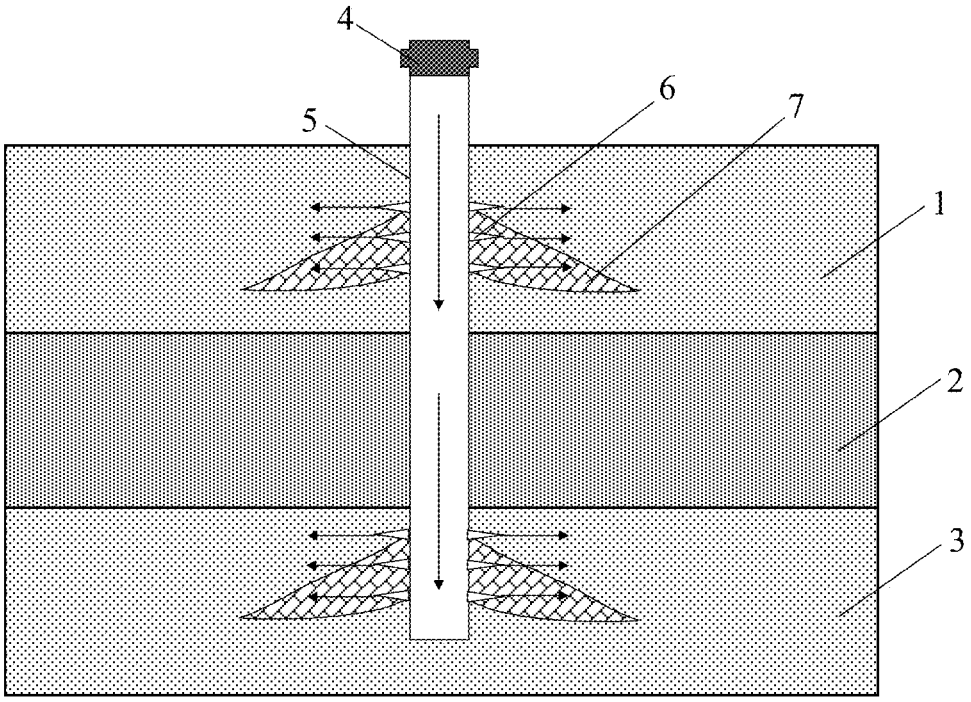
FIG. 1 is a schematic diagram of a process of forming artificial impermeable layers by injecting cement for a natural gas hydrate reservoir with permeable overburden and underburden layers.

| | | | |
|---|---|---|---|
| 1 | permeable overburden layer | 2 | hydrate layer |
| 3 | permeable underburden layer | 4 | wellhead |
| 5 | casing | 6 | perforation |

-continued

Description of reference numerals

| | | | |
|---|---|---|---|
| 7 | artificial impermeable layer | 8 | tubing |
| 9 | packer | 10 | slotting |

DETAILED DESCRIPTION OF THE EMBODIMENTS

The specific embodiments of the embodiments of the present disclosure will be further described in detail in conjunction with the accompanying drawings. It should be noted that, the specific embodiments described herein are merely intended for describing and explaining the embodiments of the present disclosure, but not for limiting the embodiments of the present disclosure.

The embodiments of the present disclosure provide a method for improving the gas recovery of a natural gas hydrate reservoir. The method provided by the embodiments of the present disclosure is introduced by using examples.

The embodiments of the present disclosure provide a method for improving the gas recovery of a natural gas hydrate reservoir by injecting cement slurry to form artificial impermeable layers. Mainly, artificial impermeable layers are formed by injecting cement slurry into a permeable overburden layer and a permeable underburden layer of the natural gas hydrate reservoir, so that a large amount of seawater is blocked from entering a hydrate layer through the permeable overburden layer and the permeable underburden layer, a pressure difference between the hydrate layer and a production well is increased, and the gas recovery of the natural gas hydrate reservoir is finally improved. The method mainly includes the following steps.

(1) According to geological data of earthquake, logging, and bottom simulating reflections (BSR) of a study area, a natural gas hydrate reservoir with a hydrate layer having a thickness of greater than 20 m and a permeable overburden layer and a permeable underburden layer having permeability of greater than 15 mD may be selected as an exploitation object.

(2) Controlled drilling is performed to drill a vertical well in the natural gas hydrate reservoir. A finished drilling horizon is located within the permeable underburden layer. The distance between the finished drilling horizon and an interface of the hydrate layer and the permeable underburden layer may range from 20 m to 40 m. Controlled perforation is performed to perforate parts of a casing of the well respectively located in the permeable overburden layer and the permeable underburden layer. The distance between the lowermost perforation point in the permeable overburden layer and an interface of the hydrate layer and the permeable overburden layer may range from 4 m to 6 m, the distance between the uppermost perforation point in the permeable underburden layer and an interface of the hydrate layer and the permeable underburden layer may range from m to 3 m, a length of the perforation in the permeable overburden layer and the permeable underburden layer may range from 6 m to 10 m, and a spacing of the perforations in the permeable overburden layer and the permeable underburden layer may range from 1 m to 2 m.

(3) G-grade oil well cement is selected, a density may be 1.89 g/$cm^3$, and a water-cement ratio may be 0.44. Controlled adding of a retarder to the oil well cement is performed to delay a solidification process. The amount of the retarder and the thickening time of the oil well cement are determined by using indoor experiments, to form a cement slurry system that matches the natural gas hydrate reservoir. The amount of the retarder may range from 2% to 5%, which is based on the amount of the cement slurry, and the thickening time may range from 4 d to 6 d, wherein d denotes day. In addition, the amount of the retarder and the thickening time of the oil well cement may be determined according to the following. The thickening time that matches the natural gas hydrate reservoir that needs to be exploitated is preset. For example, the thickening time may be determined according to experience. A high-temperature and high-pressure thickener is used, a thickening experiment is carried out under conditions of temperature, pressure, and salinity of the natural gas hydrate reservoir that needs to be exploitated, and the thickening performance of the cement slurry is tested when different amounts of retarder are added. When the thickening experiment is performed, different amounts of retarder corresponding to different thickening time, and an amount of the retarder corresponding to the preset thickening time is the amount that needs to be determined. In this way, the amount of the retarder and the thickening time of the oil well cement are determined, to form a cement slurry system that matches the natural gas hydrate reservoir after the retarder is added to the oil well cement.

(4) An injection amount and an injection speed of the cement slurry system are calculated, so that the entire cementing construction time is controlled within the thickening time, and it is ensured that the cement slurry system covers the permeable overburden layer and the permeable underburden layer within a control radius of the vertical well. The control radius is a radius of a range in which the natural gas hydrate reservoir can be obtained by using the vertical well. Steps of calculating the injection amount and the injection speed of the cement slurry system are as follows:

1, Calculating the injection amount V of the cement slurry system:

$$V=\pi r^2 h\phi,$$

wherein r is the control radius of the vertical well, h is an average thickness of the artificial impermeable layers, and $\phi$ is a porosity of the permeable overburden layer and the permeable underburden layer.

2, Calculating the injection speed of the cement slurry system:

$$q_I = \frac{VS_f}{t_0},$$

wherein $S_f$ is an injection allowance coefficient, and may range from 1.05 to 1.2, and $t_0$ is the thickening time.

(5) Controlled injecting of the cement slurry system through the casing. The cement slurry system enters the permeable overburden layer and the permeable underburden layer along a perforation interval of the vertical well. Controlling is performed to shut in the well and wait on cement setting for 2-4 d (wherein d denotes day) after the injection is completed, so that the cement slurry system solidifies to form artificial impermeable layers, to implement permanent packing of the permeable overburden layer and the hydrate layer and permanent packing of the permeable underburden layer and the hydrate layer.

(6) Controlled perforation is performed on a part of the casing located in the hydrate layer. A spacing of the perforations may range from 2 m to 4 m. Controlled lowering of tubing into the casing and slotting on the part of the tubing located in the hydrate layer are performed. Controlled installing of is performed for packers in a tubing-casing annulus space at the bottom of the permeable overburden layer and a tubing-casing annulus space at the top of the permeable underburden layer, to prevent seawater from entering the tubing through the tubing-casing annulus spaces to affect production efficiency. The distance between the packer in the permeable overburden layer and an interface of the hydrate layer and the permeable overburden layer may range from 1 m to 2 m. The distance between the packer in the permeable underburden layer and an interface of the hydrate layer and the permeable underburden layer may range from 1 m to 2 m.

(7) The vertical well is controlled to perform exploitation in a constant pressure manner. A bottom-hole flowing pressure may range from 1.5 MPa to 4.0 MPa. When a gas production rate is lower than a critical gas production rate, well shut-in is performed for ending the exploitation. The critical gas production rate may range from 2000 $m^3$/d to 3000 $m^3$/d.

The method for improving the gas recovery of the natural gas hydrate reservoir provided by the embodiments of the present disclosure has the following beneficial effects and advantages: (1) The artificial impermeable layers are formed by injecting cement slurry into the permeable overburden layer and the permeable underburden layer. A large amount of seawater can be effectively blocked from entering the hydrate layer so that a pressure difference between the hydrate layer and a production well is increased, and the gas recovery of the natural gas hydrate reservoir with the permeable overburden and underburden layers is significantly improved. (2) The injected cement slurry has higher strength after solidification, so that geological disasters such as reservoir collapse caused by hydrate decomposition can be prevented. (3) The artificial impermeable layers can also prevent methane gas, generated after the hydrate decomposition, from upwardly moving into the atmosphere, through the permeable overburden layer, to increase a greenhouse effect. (4) The well structure used in the exploitation method is simple. The exploitation method is convenient to operate and strongly economical, so that a technical means can be conveniently and economically provided for exploitation of the natural gas hydrate reservoir with permeable overburden and underburden layers.

Figure 2:
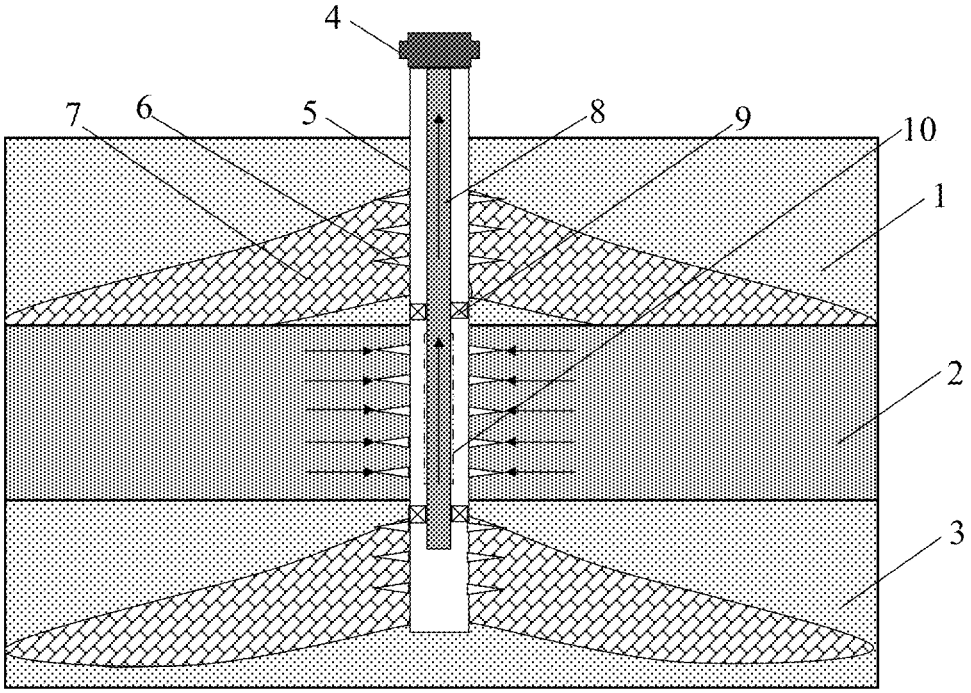
FIG. 2 is a schematic diagram of a depressurization exploitation process of a natural gas hydrate reservoir with permeable overburden and underburden layers.

The method for improving the gas recovery of the natural gas hydrate reservoir provided by the embodiments of the present disclosure is described by using examples in conjunction with FIG. 1 and FIG. 2.

(1) According to geological data of earthquake, logging, and bottom simulating reflections (BSR) of a study area, a natural gas hydrate reservoir with a hydrate layer 2 having a thickness of greater than 30 m, and a permeable overburden layer 1 and a permeable underburden layer 3, both having permeability of greater than 20 mD, is selected as an exploitation, as shown in FIG. 1.

(2) As shown in FIG. 1, controlled drilling is performed to drill a vertical well in the natural gas hydrate reservoir. A finished drilling horizon is located 25 m below an interface of the hydrate layer 2 and the permeable underburden layer 3. Controlled perforation is performed to form perforation 6 on the parts of a casing 5 located in the permeable overburden layer 1 and the permeable underburden layer 3. The lowermost perforation point in the permeable overburden layer 1 is located 5 m above an interface of the hydrate layer 2 and the permeable overburden layer 1. The uppermost perforation point in the permeable underburden layer 3 is located 2 m below an interface of the hydrate layer 2 and the permeable underburden layer 3. A length of the perforation in the permeable overburden layer 1 and the permeable underburden layer 3 is 8 m A spacing of the perforations is 1.5 m.

(3) G-grade oil well cement is selected, a density is 1.89 g/cm$^3$, and a water-cement ratio is 0.44. Controlled adding of a retarder to the cement slurry is performed to delay a solidification process of the cement slurry. The amount of the retarder and thickening time of the oil well cement was respectively determined as 3.5% and 5 d by using indoor experiments, to form a cement slurry system that matches the natural gas hydrate reservoir.

(4) An injection amount and an injection speed of the cement slurry system are calculated, so that the entire cementing construction time is controlled within the thickening time, and it is ensured that the cement slurry system covers the permeable overburden layer 1 and the permeable underburden layer 3 within a control radius of the vertical well. Steps of calculating the injection amount and the injection speed of the cement slurry system are as follows:

1, Calculating the injection amount V of the cement slurry system:

$$V=\pi r^2 h\phi, \text{ wherein}$$

r is the control radius of the vertical well, h is an average thickness of the artificial impermeable layers, and $\phi$ is a porosity of the permeable overburden layer and the permeable underburden layer.

2, Calculating the injection speed of the cement slurry system:

$$q_I = \frac{VS_f}{t_0},$$

wherein $S_f$ is an injection allowance coefficient, and $S_f$ may range from 1.05 to 1.2, and $t_0$ is the thickening time.

(5) Controlled injection of the cement slurry system through the casing 5 is performed. The cement slurry system enters the permeable overburden layer 1 and the permeable underburden layer 3 along a perforation interval of the vertical well. Controlled shutting in the well is performed, and waiting on cement setting for 3 d after the injection is completed is done, so that the cement slurry system solidifies to form artificial impermeable layers 7, as shown in FIG. 1 or FIG. 2, to implement permanent packing of the permeable overburden layer 1 and the hydrate layer 2 and permanent packing of the permeable underburden layer 3 and the hydrate layer 2.

(6) Controlled perforation is performed to form perforation 6 on the part of the casing 5 located in the hydrate layer 2. A spacing of the perforations is 3 m. Controlled lowering of a tubing 8 into the casing 5 and slotting 10 on the part of the tubing 8 located in the hydrate layer 2 are performed. Controlled installation of packers 9 in a tubing-casing annulus space at the bottom of the permeable overburden layer 1 and a tubing-casing annulus space at the top of the permeable underburden layer 3 is performed to prevent seawater from entering the tubing 8 through the tubing-casing annulus spaces to affect production efficiency. In the permeable overburden layer 1, the packer 9 is located 1.5 m above the interface of the hydrate layer 2 and the permeable overburden layer 1. In the permeable underburden layer 3, the packer 9 is located 1.5 m below the interface of the hydrate layer 2 and the permeable underburden layer 3.

(7) The vertical well is controlled to perform exploitation in a constant pressure manner. A bottom-hole flowing pressure is 3.0 MPa. When a gas production rate is lower than a critical gas production rate by 2500 m$^3$/d, well shut-in is performed for ending the exploitation.

The alternative embodiments of the embodiments of the present disclosure are described in detail above in conjunction with the accompanying drawings. However, the embodiments of the present disclosure are not limited to the specific details in the foregoing embodiments. Within the scope of the technical concept of the embodiments of the present disclosure, various simple variants can be made on the technical solution of the embodiments of the present disclosure, and these simple variants fall into the scope of protection of the embodiments of the present disclosure.

Aspects of the disclosure is directed to a non-transitory computer-readable medium storing instruction which, when executed, cause one or more processors to perform the methods, as discussed above. The computer-readable medium may include volatile or non-volatile, magnetic, semiconductor, tape, optical, removable, non-removable, or other types of computer-readable medium or computer-readable storage devices. For example, the computer-readable medium may be the storage device or the memory module having the computer instructions stored thereon, as disclosed. In some embodiments, the computer-readable medium may be a disc or a flash drive having the computer instructions stored thereon.

Aspects of the disclosure is directed to a computer program product comprising program instructions, when executed on a data-processing apparatus, adapted to provide any of the system described above, or adapted to perform any of the method steps described above.

It should be further noted that the specific technical features described in the above specific embodiments may be combined in any suitable manner without contradiction. To avoid unnecessary repetition, various possible combinations of the embodiments of the present disclosure are not separately described.

In addition, the various embodiments of the embodiments of the present disclosure may be combined in any combination, provided that the combination does not deviate from the idea of the embodiments of the present disclosure, and should also be regarded as the contents disclosed by the embodiments of the present disclosure.

The invention claimed is:

1. A method for improving gas recovery of a natural gas hydrate reservoir, wherein the natural gas hydrate reservoir comprises a permeable overburden layer, a hydrate layer and a permeable underburden layer, the method comprising:

drilling a vertical well in the natural gas hydrate reservoir, placing a casing in the vertical well, and perforating parts of the casing located in the permeable overburden layer and the permeable underburden layer to provide a perforation interval in each of the permeable overburden layer and the permeable underburden layer;

adding a retarder to oil well cement to form a cement slurry system and determining thickening time of the oil well cement;

calculating an injection speed of the cement slurry system to provide a cementing construction time within the thickening time and an injection amount of the cement slurry system to cover the permeable overburden layer and the permeable underburden layer within a control radius of the vertical well;

injecting the cement slurry system through the casing, wherein the cement slurry system enters the permeable overburden layer and the permeable underburden layer along the perforation interval, and shutting in the well and waiting on the cement to set for a preset time after the injecting, wherein the preset time ranges from 2 d to 4 d, so that the cement slurry system solidifies to form artificial impermeable layers, to implement packing of the permeable overburden layer and the hydrate layer and packing of the permeable underburden layer and the hydrate layer;

perforating a part of the casing located in the hydrate layer lowering a tubing into the casing and slotting the tubing on a part of the tubing located in the hydrate layer, and installing packers in a tubing-casing annulus space at the bottom of the permeable overburden layer and a tubing-casing annulus space at the top of the permeable underburden layer; and controlling operation of the vertical well to perform exploitation in a constant pressure manner, and when a gas production rate is lower than a critical gas production rate, performing well shut-in for ending the exploitation.

2. The method according to claim 1, wherein a finished drilling horizon of the vertical well is located within the permeable underburden layer and the distance between the finished drilling horizon and an interface of the hydrate layer and the permeable underburden layer ranges from 20 m to 40 m.

3. The method according to claim 1, wherein the distance between the lowermost perforation point in the permeable overburden layer and an interface of the hydrate layer and the permeable overburden layer ranges from 4 m to 6 m.

4. The method according to claim 1, wherein the distance between the uppermost perforation point in the permeable underburden layer and an interface of the hydrate layer and the permeable underburden layer ranges from 1 m to 3 m.

5. The method according to claim 1, wherein both the distance between the packer in the permeable overburden layer and an interface of the hydrate layer and the permeable overburden layer and the distance between the packer in the permeable underburden layer and an interface of the hydrate layer and the permeable underburden layer range from 1 m to 2 m.

6. The method according to claim 1, wherein a bottom-hole flowing pressure ranges from 1.5 MPa to 4.0 MPa when the vertical well is controlled to perform exploitation in the constant pressure manner.

7. The method according to claim 1, wherein the critical gas production rate ranges from 2000 $m^3/d$ to 3000 $m^3/d$.

* * * * *